US010221518B2

(12) United States Patent
Schapiro

(10) Patent No.: US 10,221,518 B2
(45) Date of Patent: Mar. 5, 2019

(54) SKIRT CLIP

(71) Applicant: CLEANER'S SUPPLY, INC., Conklin, NY (US)

(72) Inventor: Jeffrey Schapiro, Conklin, NY (US)

(73) Assignee: CLEANER'S SUPPLY INC., Conklin, NY (US)

( * ) Notice: Subject to any disclaimer, the term of this patent is extended or adjusted under 35 U.S.C. 154(b) by 16 days.

(21) Appl. No.: 15/628,715

(22) Filed: Jun. 21, 2017

(65) Prior Publication Data

US 2018/0110351 A1 Apr. 26, 2018

Related U.S. Application Data

(60) Provisional application No. 62/412,890, filed on Oct. 26, 2016.

(51) Int. Cl.
*D06F 55/00* (2006.01)
*A47G 25/48* (2006.01)

(52) U.S. Cl.
CPC ..... *D06F 55/00* (2013.01); *A47G 25/48* (2013.01); *A47G 25/485* (2013.01)

(58) Field of Classification Search
CPC ..... A47G 25/32; A47G 25/36; A47G 25/50; A47G 25/48; A47G 25/445; A47G 25/481–25/488; D06F 53/00; D06F 53/02; A44C 3/00; E05D 7/00; F16B 2/20; B42F 1/02
USPC ..... D20/43; D6/323, 328; D32/61
See application file for complete search history.

(56) References Cited

U.S. PATENT DOCUMENTS 3,135,034 A * 6/1964 Fauteux ..... D06F 55/00 24/327
3,405,429 A * 10/1968 Vazquez ..... A47G 25/485 223/96
4,493,495 A * 1/1985 Linn ..... B42F 9/00 24/494
4,706,347 A * 11/1987 Lindsay ..... A47G 25/32 223/96
5,179,768 A * 1/1993 Jio ..... D06F 55/00 24/499
5,669,590 A * 9/1997 Przewodek ..... F16L 3/221 248/68.1
7,360,286 B2 * 4/2008 Shimizu ..... A47G 25/483 223/95

* cited by examiner

*Primary Examiner* — Ismael Izaguirre
(74) *Attorney, Agent, or Firm* — Robert L. Epstein; Epstein Drangel LLP

(57) ABSTRACT

The clip is formed of resilient plastic material and includes first and second parts pivotally connected by a connecting member. Each of the parts includes a gripping portion and a locking portion. Each of the gripping portions includes first and second connected portions, at least one of which has a gripping surface. A locking part is pivotally mounted to one of the locking portions for movement relative to the other locking portion between locked and unlocked positions. The locking part is adapted to engage the other of the locking portions in the locking position. Movement of the locking part toward the locked position causes the gripping surfaces to move toward each other to retain the article therebetween.

24 Claims, 4 Drawing Sheets

SKIRT CLIP

CROSS-REFERENCE TO RELATED APPLICATIONS

Priority is claimed on Provisional Patent Application Ser. No. 62/412,890, filed Oct. 26, 2016, the entirety of which is incorporated herein by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to devices for hanging clothing and more particularly to a plastic clip designed for hanging a garment such as a skirt from a clothes hanger.

2. Description of Prior Art Including Information DISCLOSED UNDER 37 CFR 1.97 AND 1.98

Two types of clips for suspending garments such as skirts from clothes hangers are commonly available. One type, available from Cleaner's Supply of Conklin, N.Y. 13748, consists of a generally upside down "U" shaped flexible plastic body including downwardly extending griping members with inwardly directed surface gripping protrusions. Oppositely oriented arcuate parts are attached to the exterior surface of the central portion of the clip body. The gripping members are normally spaced apart to allow the insertion of a garment therebetween. Applying inwardly directed forces on the sides of the body causes the gripping members to move from the spaced position toward each other to grip the garment therebetween. Interlocking cross-member parts extend inwardly from the interior surfaces of the body and lock together to maintain the gripping members in the garment gripping position.

The second type of clip is disclosed in U.S. Pat. No. 7,360,286 and available from Maruso Industry Co., Ltd. of Fukuoka, Japan. As described in that patent, the Maruso clip includes a connecting piece. First and second pinching pieces having smooth inside surfaces are movably connected to the ends of the connecting piece at positions under upper ends of the first and second pinching pieces. A vertical piece extends downwardly from the center of the connecting piece. The vertical piece has two protrusions extending from the lower end portion. Each of the protrusions is directed toward an inner side of a different one of the first and second pinching pieces. A lock piece is movably connected to the upper end of the first pinching piece. The lock piece functions to maintain the inside surfaces of the first and second pinching pieces pressed toward the protrusions by engaging the upper end portion of the second pinching piece.

The Maruso clip is more complex than the Cleaner's Supply. Further, it is more awkward to use because it requires that the vertical piece be inserted between the layers of the garment. Further, it does not grip garment made of all types of fabric securely and the lock piece is difficult to release.

Accordingly, there is a need for a better clip which is easier to manipulate, capable of securely griping garments made of all types of fabric and easier to release.

BRIEF SUMMARY OF THE INVENTION

It is a prime object of the present invention to provide a clip for a garment such as a skirt.

It is another object of the present invention to provide a skirt clip which is easy to manipulate.

It is another object of the present invention to provide a skirt clip which does not require insertion between the layers of the garment.

It is another object of the present invention to provide a skirt clip which securely grips garments made of all types of fabrics.

It is another object of the present invention to provide a skirt clip which is easy to release.

It is another object of the present invention to provide a skirt clip which is formed of a single part of injection molded plastic.

It is another object of the present invention to provide a skirt clip which is inexpensive to manufacture.

It is another object of the present invention to provide a skirt clip of simple construction which has a long useful life.

In accordance with the present invention, a clip for retaining a garment is provided. The clip is formed of resilient plastic material and includes first and second parts pivotally connected by a connecting member. Each of the parts includes a gripping portion below the connecting member and a locking portion above the connecting member. Each of the gripping portions includes a gripping member having an end and an inner part having a gripping surface attached to the end. Each of the locking portions has an end. A locking part is pivotally mounted to the end of one of the locking portions for movement relative to the other locking portion between locked and unlocked positions. The locking part is adapted to engage the end of the other of the locking portions in its locked position. The locking part causes the gripping members to move toward each other as it is moved toward its locked position such that the gripping surfaces of the inner parts retain the garment therebetween.

One or both of the inner parts include a member limiting the amount of movement of the inner part toward the gripping member to which it is attached.

The clip further includes at least two spaced protrusions mounted on one or both of the gripping surfaces.

The locking part includes an arcuate portion adapted to engage the end of the other locking portion. The locking part further includes a part extending beyond the arcuate portion to facilitate grasping of the locking part for easier release. The grasping part extends from the locking part in a direction substantially parallel to the connecting member, when the locking part is in the locked position.

In accordance with another aspect of the present invention, a clip for retaining a garment, the clip is formed of resilient plastic material and includes first and second parts pivotally connected by a connecting member. Each of the parts has a gripping portion and a locking portion. Each of the gripping portions has a gripping surface. A locking part is pivotally mounted to one of the locking portions for movement relative to the other locking portion between locked and unlocked positions. The locking part is adapted to engage the other of the locking portions in its locked position. The movement of the locking part toward its locked position causes the gripping surfaces to move toward each other to retain the garment therebetween.

One or both of the gripping portions includes an inner part attached thereto. A member is provided limiting the amount of movement of the inner part toward the gripping portion to which it is attached.

At least two spaced protrusions are mounted on one or both of the gripping surfaces.

The locking part includes an arcuate portion adapted to engage the end of the other locking portion. The locking part includes a part extending beyond the arcuate portion of the locking part to facilitate grasping of the locking part. The grasping part extends from the locking part in a direction substantially parallel to the connecting member, when the locking part is in the locked position.

In accordance with another aspect of the present invention, a clip is provided for retaining a garment. The clip includes first and second parts pivotally connected by a connecting member. Each of the parts includes a gripping portion and a locking portion. Each of the gripping portions includes first and second connected portions, at least one of which has a gripping surface. A locking part is pivotally mounted to one of the locking portions for movement relative to the other locking portion between locked and unlocked positions. The locking part is adapted to engage the other of the locking portions in the locking position. Movement of the locking part toward the locked position causes the gripping surfaces to move toward each other to retain the garment therebetween.

One or both of the gripping portions includes an inner part attached thereto. A member is provided for limiting the amount of movement of the inner part toward the gripping portion to which it is attached.

At least two spaced protrusions are mounted on one or both of the gripping surfaces.

The locking part includes an arcuate portion adapted to engage the end of the other locking portion. The locking part includes a part extending beyond the arcuate portion of the locking part to facilitate grasping of the locking part. The grasping part extends from the locking part in a direction substantially parallel to the connecting member, when the locking part is in its locked position.

BRIEF DESCRIPTION OF THE SEVERAL VIEWS OF DRAWINGS

To these and to such other objects that may hereinafter appears, the present invention relates to a clip for a garment such as a skirt as described in detail in the following specification and recited in the annexed claims, taken together with the accompanying drawings, in which like numerals refer to like parts and in which:

DETAILED DESCRIPTION OF THE INVENTION

Figure 2:
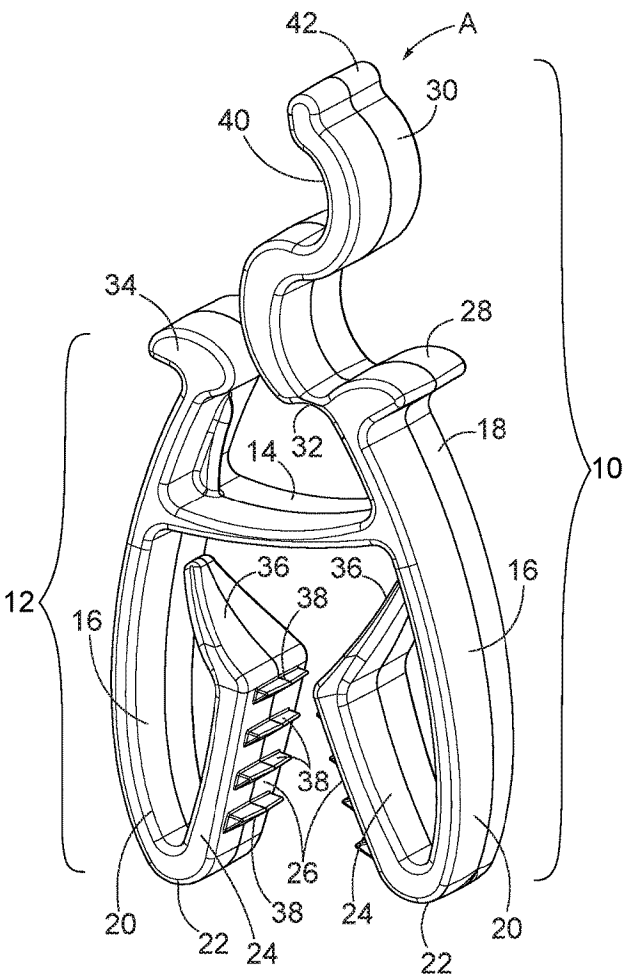
FIG. 2 is a perspective view of the clip of the present invention showing the front, top and other side thereof.
Figure 1:
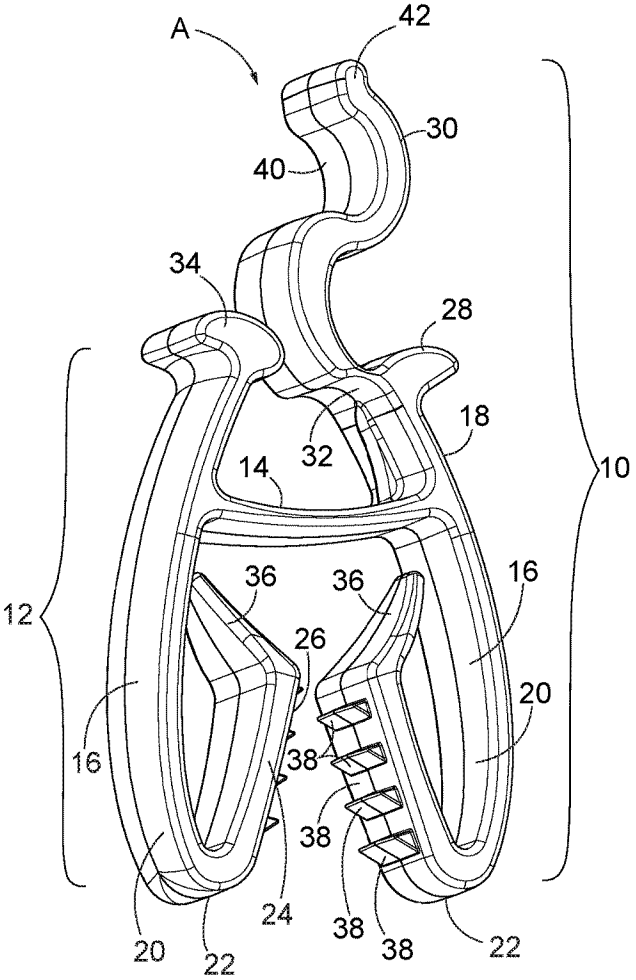
FIG. 1 is a perspective view of the clip of the present invention showing the front, bottom and one side thereof.

As illustrated in the figures, the present invention relates to a clip, generally designated A, for retaining a garment, generally designated B, such as a skirt. As will become apparent from the following description, the clip is formed of resilient material such as plastic such that it is somewhat flexible.

The clip includes a first part, generally designated 10 and a second part generally designated 12. Parts 10 and 12 are connected by a connecting member 14.

Each of the parts 10, 12 includes a gripping portion 16, 17 situated below connecting member 14 and a locking portion 18, 19 situated above connecting member 14. Each of the gripping portions 16, 17 includes a gripping member 20 having an end 22 and an inner part 24 attached to end 22. Each inner part 24 has a gripping surface 26.

Figure 3:
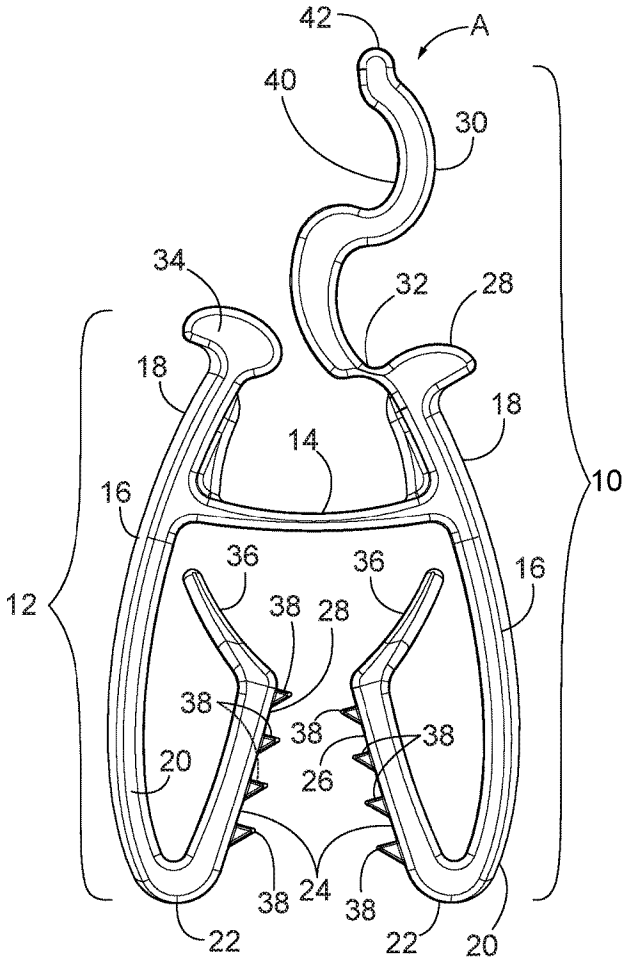
FIG. 3 is a front elevation view of the clip with the locking part in the unlocked position.

Each of the locking portions 18, 19 has an end 28, 34. A locking part 30 is pivotally mounted to end 28 of locking portion 18 by a living hinge 32. Locking part 30 is moveable relative to the end 34 of the locking portion 19 between unlocked and locked positions, seen in FIGS. 3 and 4, respectively.

In its locked position, locking part 30 engages end 34 of locking portion 19. The locking part causes gripping members 20 to move toward each other as the locking part is moved toward its locked position such that the gripping surfaces 26 of inner parts 24 retain article B therebetween.

Figure 4:
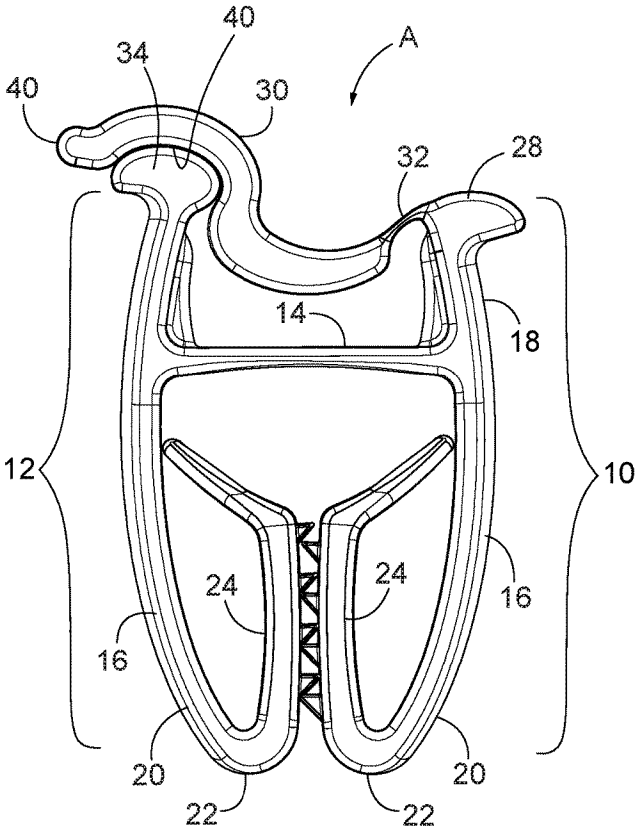
FIG. 4 is a front elevation view of the clip with the locking part in the locked position.
Figure 5:
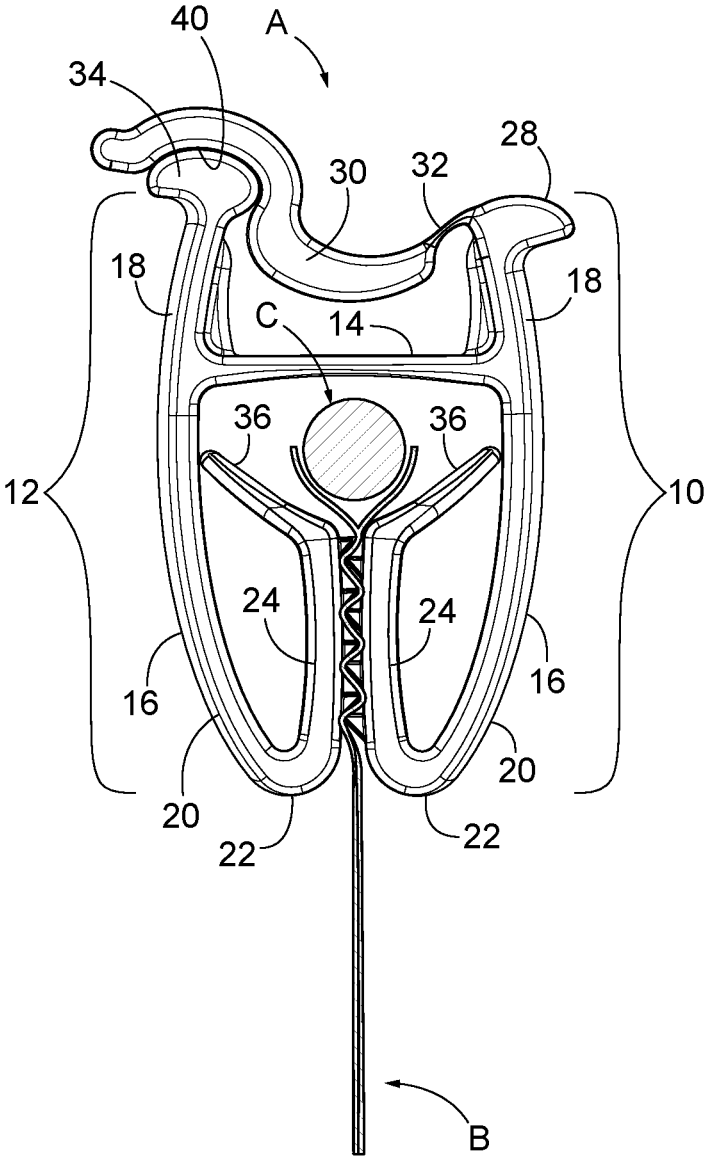
FIG. 5 is a cross-sectional view of the clip in the locked position as it would appear mounted on a hanger and retaining a skirt.

The inner parts 24 each carry a member 36 extending from the end thereof which limits the movement of the inner part toward the gripping member 20 to which it is attached, as seen in FIGS. 4 and 5. Each of the movement limiting members 36 extends at an obtuse angle from the end of the inner part to which it is attached.

At least two spaced teeth or protrusions 38 are mounted on one or both inner part surfaces 24. In the preferred embodiment shown in the drawings, four protrusions 38 on each inner part are provided. The protrusions increase the gripping capability of the clip such that it can be used for garments of all fabrics.

Locking part 30 has a generally "S" shape including an arcuate portion 40 adapted to engage end 34 of locking portion 19 of part 12, as shown in FIGS. 4 and 5.

Locking part 30 also has a part 42 extending beyond arcuate portion 40 which is shaped and located to facilitate grasping of the locking part. Part 42 extends from the locking part in a direction substantially parallel to connecting member 14, when the locking part is in its locked position.

Figure 6:
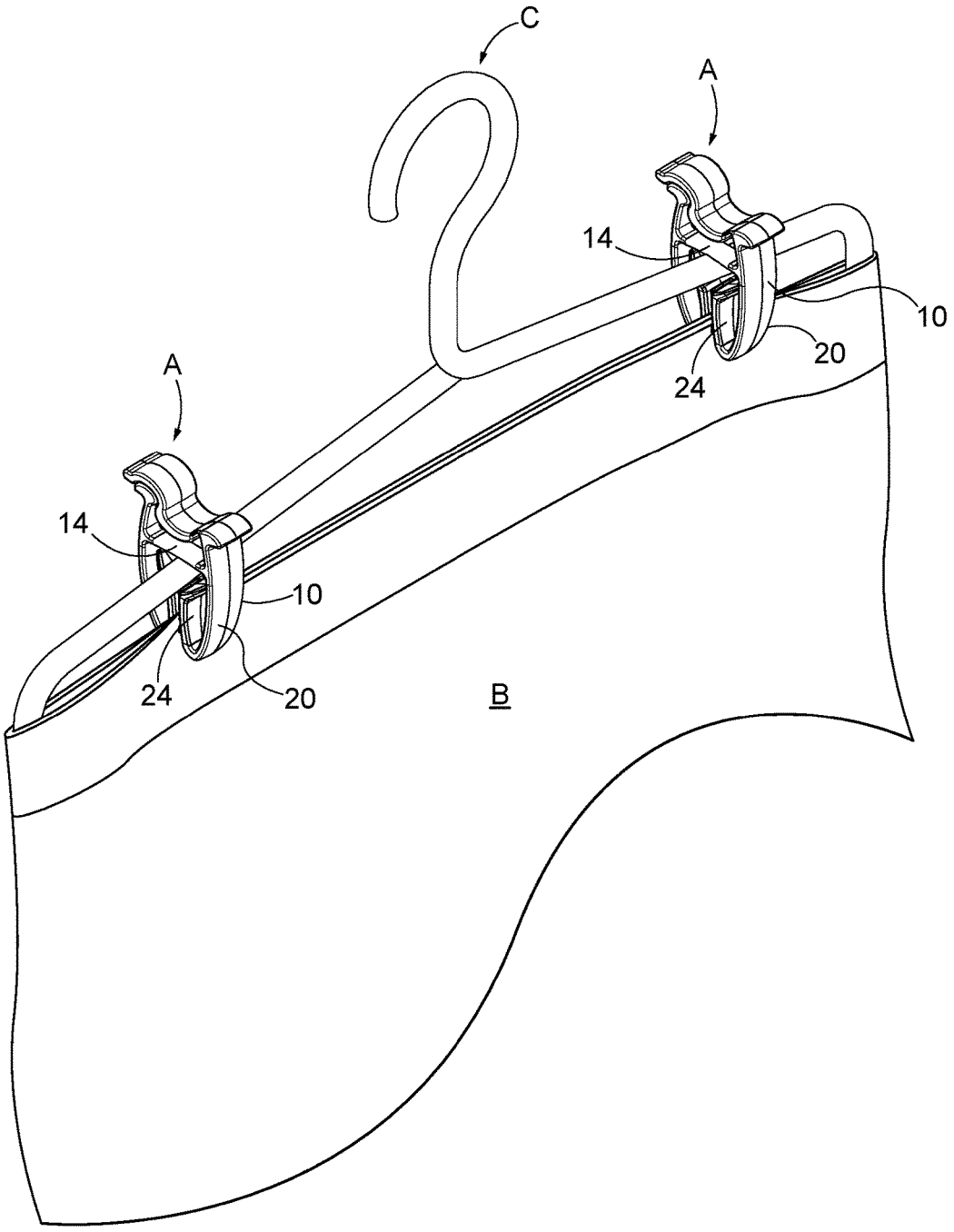
FIG. 6 is a perspective view of a hanger with spaced clips as it would appear in use.

FIGS. 5 and 6 illustrate the clip of the present invention in use. As seen in FIG. 6, two clips A are used with a conventional wire hanger, generally designated C. Each clip is positioned on the hanger proximate a different end thereof and is locked as described above to retain garment B such that both ends of the garment are supported evenly and securely by the hanger.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

I claim:

1. A clip for retaining a garment formed of resilient plastic material comprising first and second parts flexibly connected by a connecting member, each of said parts comprising a gripping portion below said connecting, member and a locking portion above said connecting member, each of said gripping portions comprising a gripping member having an outer portion and an inner portion, said inner portion comprising a substantially planar gripping surface, a locking part mounted for movement between locked and unlocked positions, wherein said locking part causes said gripping members to move toward each other as it is moved toward said locked position such that said gripping surfaces of said inner portions are aligned substantially parallel relation so as to retain the garment therebetween.

2. The clip of claim 1 wherein one of said inner parts comprises a member limiting the amount of movement of said inner part toward the gripping member to which it is attached.

3. The clip of claim 1 wherein each of said inner parts comprises a member limiting the amount of movement of the inner part toward the gripping member to which it is attached.

4. The clip of claim 1 further comprising at least two spaced protrusions mounted on at least one of said gripping surfaces.

5. The clip of claim 1 further comprising at least two spaced protrusions mounted on of each of said gripping surfaces.

6. The clip of claim 1 wherein said locking part comprises an arcuate portion and a part extending beyond said arcuate portion to facilitate grasping of said locking part.

7. The clip of claim 6 wherein said grasping part extends from said locking part in a direction substantially parallel to said connecting member, when said locking part is in, its locked position.

8. A clip for retaining a garment formed of resilient plastic material comprising first and second parts pivotally connected by a connecting member, each of said parts comprising a gripping portion and a locking portion, each of said gripping portions comprising a generally "U" shaped member comprising an inner portion having a gripping surface, a locking part pivotally mounted to one of said locking portions for movement relative to said other locking portion between locked and unlocked positions, said locking part being adapted to engage said other of said locking portions in said locked position, wherein movement of said locking part toward said locked position causes said gripping surfaces to move toward each other to align in substantially parallel relation to retain the garment therebetween.

9. The clip of claim 8 wherein one of said inner portions comprises an outer portion and a member limiting the amount of movement of said inner portion toward said outer portion.

10. The clip of claim 8 wherein said movement limiting member extends from said inner portion toward said outer portion.

11. The clip of claim 8 further comprising at least two spaced protrusions mounted on at least one of said gripping surfaces.

12. The clip of claim 8 further comprising at least two spaced protrusions mounted on of each of said gripping surfaces.

13. The clip of claim 8 wherein said locking part comprises an arcuate portion and a part extending beyond said arcuate portion to facilitate grasping of said locking part.

14. The clip of claim 13 wherein said grasping part extends from said locking part in, a direction substantially parallel to said connecting member, when said locking part is in its locked position.

15. A clip for retaining a garment comprising first and second parts flexibly connected by a connecting member each of said parts comprising a gripping portion and a locking portion, each of said gripping portions comprising first and second connected portions each of which comprises an inner portion having a gripping surface, an end and a member extending from said inner portion end at an obtuse angle, a locking part mounted for movement between locked and unlocked positions, wherein movement of said locking part toward said locked position causes said gripping surfaces to move toward each other to retain the article therebetween.

16. The clip of claim 15 further comprising at least two spaced protrusions mounted on at least one of said gripping surfaces.

17. The clip of claim 15 wherein said locking part comprises an arcuate portion and a part extending beyond said arcuate portion to facilitate grasping of said locking part.

18. The clip of claim 17 wherein said grasping part extends from said locking part in a direction substantially parallel to said connecting member, when said locking part is in its locked position.

19. A clip for retaining a garment formed of resilient plastic material comprising first and second parts pivotally connected by a connecting member, each of said parts comprising a gripping portion below said connecting member and a locking portion above said connecting member, each of said gripping portions comprising a gripping member having an end and an inner part comprising a gripping surface attached to said end, and each of said locking portions comprising an end, a locking part pivotally mounted to said end of one of said locking portions for movement relative to said other locking portion between locked and unlocked positions, said locking part adapted to engage said end of the other of said locking portions in said locked position, wherein said locking part causes said gripping members to move toward each other as it is moved toward, said locked position such that said gripping surfaces of said inner parts retain the garment therebetween, wherein one of said inner parts comprises a member limiting the amount of movement of said inner part toward the gripping member to which it is attached.

20. A clip for retaining a garment formed of resilient plastic material comprising first and second parts pivotally connected by a connecting member, each of said parts comprising a gripping portion below said connecting member and a locking portion above said connecting member, each of said gripping portions comprising a gripping member having an end and an inner part comprising a gripping surface attached to said end, and each of said locking portions comprising an end, a locking part pivotally mounted to said end of one of said locking portions for movement relative to said other locking portion between locked and unlocked positions, said locking part adapted to engage said end of the other of said locking portions in said locked, position, wherein said locking part causes said gripping members to move toward each other as it is moved toward said locked position such that said gripping surfaces of said inner parts retain the garment therebetween, wherein each of said inner parts comprises a member limiting the amount of movement of the inner part toward the gripping member to which it is attached.

21. A clip for retaining a garment formed of resilient plastic material comprising first and second parts pivotally connected by a connecting member, each of said parts comprising a gripping portion and a locking portion, each of said gripping portions comprising a gripping surface, a locking part pivotally mounted to one of said locking portions for movement relative to said other locking portion between locked and unlocked positions, said locking part being adapted to engage said other of said locking portions in said locked position, wherein movement of said locking part toward said locked position causes said gripping surfaces to move toward each other to retain the garment therebetween, wherein each of said gripping portions comprises an inner part attached thereto and a member limiting the amount, of movement of said inner member toward the gripping portion to which it is attached.

22. A clip for retaining a garment comprising first and second parts pivotally connected by a connecting member, each of said parts comprising a gripping portion and a locking portion, each of said gripping portions comprising first and second connected portions one of which has a gripping surface, a locking part pivotally mounted to one of said locking portions for movement relative to said other locking portion between locked and unlocked positions, said locking part being adapted to engage said other of said locking portions in said locking position, wherein movement of said locking part toward said locked position causes said gripping surfaces to move toward each other to retain the article therebetween, wherein each of said gripping portions comprises member limiting the amount of movement of said gripping portion.

23. A clip for retaining a garment comprising first and second parts pivotally connected by a connecting member, each of said parts comprising a gripping portion and a locking portion, each of said gripping portions comprising first and second connected portions one of which has a gripping surface, a locking part pivotally mounted to one of said locking portions for movement relative to said other locking portion between locked and unlocked positions, said locking part being adapted to engage said other of said locking portions in said locking position, wherein movement of said locking part toward said locked position causes said gripping surfaces to move toward each other to retain the article therebetween, wherein said locking part comprises an arcuate portion and further comprising a part extending beyond said arcuate portion to facilitate grasping of said, locking part.

24. A clip for retaining a garment comprising first and second parts pivotally connected by a connecting member, each of said parts comprising a gripping portion and a locking portion, each of said gripping portions comprising first and second connected portions one of which has a gripping surface, a locking part pivotally mounted to one of said locking portions for movement relative to said other locking portion between locked and unlocked positions, said locking part being adapted to engage said other of said locking portions in said locking position, wherein movement of said locking part toward said locked position causes said gripping surfaces to move toward each other to retain the article therebetween, wherein said grasping part extends from said locking part in a direction substantially parallel to said connecting member, when said locking part is in its locked position.

* * * * *